US009440346B2

(12) United States Patent
Grysen, Jr. et al.

(10) Patent No.: US 9,440,346 B2
(45) Date of Patent: Sep. 13, 2016

(54) TOOL HAVING A TOOL MEMBER CONFIGURED FOR SUBSEQUENT INSTALLATION

(71) Applicant: LEATHERMAN TOOL GROUP, INC., Portland, OR (US)

(72) Inventors: Bernard John Grysen, Jr., Portland, OR (US); Peter Parker, Portland, OR (US)

(73) Assignee: Leatherman Tool Group, Inc., Portland, OR (US)

( * ) Notice: Subject to any disclaimer, the term of this patent is extended or adjusted under 35 U.S.C. 154(b) by 216 days.

(21) Appl. No.: 14/148,170

(22) Filed: Jan. 6, 2014

(65) Prior Publication Data

US 2015/0190915 A1 Jul. 9, 2015

(51) Int. Cl.
*B25F 1/00* (2006.01)
*B25F 1/04* (2006.01)

(52) U.S. Cl.
CPC ..... *B25F 1/003* (2013.01); *B25F 1/04* (2013.01); *Y10T 29/49826* (2015.01)

(58) Field of Classification Search
CPC ..... B25F 1/04; B25F 1/003; B25B 7/06; B25B 7/22; B26B 11/003; B26B 1/04; Y10T 29/49826
USPC ..... 7/127–129, 118
See application file for complete search history.

(56) References Cited

U.S. PATENT DOCUMENTS 1,413,954 A * 4/1922 Ball ..... B26B 5/00 30/151
5,142,721 A 9/1992 Sessions et al.
5,212,844 A 5/1993 Sessions et al.
5,351,761 A 10/1994 Henthorn
D366,408 S 1/1996 Sessions et al.
5,511,310 A 4/1996 Sessions et al.
D427,501 S 7/2000 Berg et al.
6,088,861 A 7/2000 Sessions et al.
D429,621 S 8/2000 Rivera
6,128,805 A 10/2000 Rivera
D436,514 S 1/2001 Rivera
6,510,767 B1 1/2003 Rivera
6,622,328 B2 9/2003 Rivera
6,675,419 B2 * 1/2004 Rivera ..... A45D 26/0066 7/128
6,675,484 B2 * 1/2004 McHenry ..... B26B 1/048 30/161
D496,846 S 10/2004 Rivera et al.
D496,847 S 10/2004 Rivera et al.
D497,095 S 10/2004 Rivera et al.
D497,096 S 10/2004 Rivera et al.
(Continued)

OTHER PUBLICATIONS

Partial European Search Report on corresponding European Application No. EP 14004048.6, mailed Jun. 8, 2015.
(Continued)

*Primary Examiner* — Hadi Shakeri
(74) *Attorney, Agent, or Firm* — Alston & Bird LLP

(57) ABSTRACT

A tool, such as a multipurpose tool, is provided that is designed to receive a separate tool member configured to be installed after assembly of the tool. In this regard, the tool may have a retention mechanism configured to accept a separate tool member. A method of installing a tool member onto a tool is also provided. Also provided is a tool that includes a release mechanism to allow tool members to fold into the tool whereby the release mechanism is actuatable by tabs positioned on the sides of the handles outside of the path of travel of the tool member.

13 Claims, 13 Drawing Sheets

(56) References Cited

U.S. PATENT DOCUMENTS

| | | | | |
|---|---|---|---|---|
| 6,802,094 | B2 | 10/2004 | Seber et al. | |
| 6,957,466 | B2 | 10/2005 | Rivera | |
| 7,051,627 | B2 | 5/2006 | Rivera | |
| 7,080,423 | B2 | 7/2006 | Seber et al. | |
| 7,146,668 | B2 | 12/2006 | Rivera | |
| 7,182,001 | B2 | 2/2007 | Rivera | |
| 7,185,569 | B2 | 3/2007 | Knight et al. | |
| 7,347,128 | B2 | 3/2008 | Rivera et al. | |
| 7,415,745 | B2 * | 8/2008 | Rivera | B25F 1/003 7/128 |
| D595,103 | S | 6/2009 | Goodrich | |
| D595,440 | S | 6/2009 | Rivera et al. | |
| D596,556 | S | 7/2009 | Kuwano | |
| 7,568,408 | B2 | 8/2009 | Tsuda | |
| 7,634,956 | B2 | 12/2009 | Rivera et al. | |
| 7,654,004 | B2 | 2/2010 | Tsuda | |
| 7,921,752 | B2 * | 4/2011 | Poehlmann | B25F 1/04 7/128 |
| 8,028,419 | B2 * | 10/2011 | VanHoy | B26B 1/044 7/118 |
| 8,161,653 | B2 | 4/2012 | Nenadic | |
| 8,166,850 | B2 | 5/2012 | Caniparoli et al. | |
| 8,528,451 | B2 | 9/2013 | Steineckert et al. | |
| 2012/0151681 | A1 | 6/2012 | Purnomohadi et al. | |

OTHER PUBLICATIONS

"Ranger 151 Swiss Army Knife," http://www.wengerna.com/ranger-151-16307, Advertisement of Wenger, 2 pages, Jan. 7, 2014.

Extended European Search Report on corresponding European Application No. EP 14004048.6 dated Oct. 2, 2015, 9 pages.

* cited by examiner

TOOL HAVING A TOOL MEMBER CONFIGURED FOR SUBSEQUENT INSTALLATION

FIELD

Embodiments of the present invention relate generally to tools and, more particularly, to a tool, such as a multipurpose tool, configured to accept additional tool members and/or to allow tool members to fold into a handle of the tool in response to actuation of a tab defined by a scale of the handle.

BACKGROUND

Multipurpose tools are widely popular for their utility in a substantial number of different applications. As its name suggests, a multipurpose tool includes a number of tool members carried by common frame. A multipurpose tool may include different combinations of tool members depending upon its intended application. For example, multipurpose tools that are designed for a more universal or generic application can include pliers, a wire cutter, a bit driver, one or more knife blades, a saw blade, a bottle opener or the like. Other multipurpose tools are designed to service more specific applications or niche markets and correspondingly include tool members that are useful for the intended application. For example, multipurpose tools may be specifically designed for automobile repairs, hunting, fishing or other outdoor applications, gardening, and the like.

One reason for the popularity of multipurpose tools is the capability provided by a multipurpose tool to provide a wide range of functionality with a single tool, thereby reducing the need to carry a number of different tools to perform those same functions. For example, a single multipurpose tool may be carried instead of a pair of pliers, one or more screwdrivers, a knife and a bottle opener. As such, the burden upon a user is reduced since the user need only carry a single multipurpose tool.

As multipurpose tools are frequently carried by users in the field, it is desirable for the multipurpose tools to be relatively small and lightweight while remaining rugged so as to resist damage. In order to reduce the overall size of a multipurpose tool, some multipurpose tools have been designed to be foldable. In this regard, foldable multipurpose tools are designed to move between a closed position and an open position. Generally, the closed position is more compact with the multipurpose tool frequently being carried in the closed position. Conversely, while the open position is generally less compact than the closed position, the open position generally allows the deployment of one or more of the tool members that are stowed and relatively inaccessible when the multipurpose tool is in the closed position.

For example, a multipurpose tool may include pliers or scissors having a pair of jaws connected to respective handles. In the open position, the pliers or scissors are deployed and capable of being actuated by movement of the handles toward and away from one another. In the closed position, the handles may be folded about the pliers or scissors such that the pliers or scissors are no longer functional. In the closed position, however, the multipurpose tool is more compact with the form factor generally defined by the proximal relationship of the handles. The pliers or scissors may be spring-actuated to assume an open position in the absence of any forces applied by a user who moves the handles toward one another and, in turn, move the pliers or scissors to a closed position. As noted above, a multipurpose tool may include a large number and wide variety of tool members. However, some users of a multipurpose tool may not utilize all of the tool members. These unused tool members may consequently fail to serve a useful purpose (for a particular user) and, may, instead, unnecessarily increase the complexity and the weight of the multipurpose tool.

BRIEF SUMMARY

According to embodiments of the present invention, a tool, such as a multipurpose tool, is provided that is designed to receive a separate tool member configured to be installed after assembly and delivery of the tool. In this regard, the tool of one embodiment may have a retention mechanism configured to accept a separate tool member and to thereafter securely retain the separate tool member. In another embodiment, a corresponding method of installing a tool member onto a tool is provided. As such, a tool, such as a multipurpose tool, may be provided that may include a fewer number of tool members such that the tool is less complex and lighter weight. By providing the separate tool member, however, the tool and corresponding method of an example embodiment may permit the separate tool member to be added by a user if desired so as to increase the functionality of the tool at the cost of complexity and weight for those users desirous of the increased functionality. In another embodiment, a tool may be provided that includes a release mechanism to allow tool members to fold into the tool with the release mechanism being actuatable by tabs positioned on the sides of the handles outside of the path of travel of the tool member.

In one embodiment, a multipurpose tool is provided that has a plurality of handles configured for relative movement between a closed position and an open position. The plurality of handles include at least one handle that comprises an opening configured to receive a separate tool member, such as a knife blade, and an axle upon which the separate tool member is rotatably mounted. The multipurpose tool includes a plurality of tool members carried by at least one of the handles. The multipurpose tool also includes a separate tool member that is configured to be installed following the assembly of the tool. The separate tool member comprises a tang and defines an open slot on the tang that is configured to receive the axle. The tool also comprises a lock carried by a respective handle with the lock being configured to engage the separate tool member upon installation of the separate tool member such that the open slot of the separate tool member is mounted upon the axle. The tang of the tool member includes a retention feature and the lock is configured to engage the retention feature to secure the separate tool member within the tool following the installation of the separate tool member. In an embodiment in which the separate tool member is a knife blade, the tool may also optionally include a knife guard removably mounted upon the knife blade.

In an additional embodiment, the tang of the separate tool member comprises a step feature configured to engage a lock. The step feature may define a shelf which may extend around a portion of the tang concentric to the slot on the tang.

According to another embodiment, the lock comprises a retention edge designed to engage the step feature of the separate tool member. When the separate tool member is in the open position, the step feature of the separate tool member is not engaged with the retention edge of the lock. As the separate tool member rotates along the axle from an open to a closed position, the retention edge slides along the step feature, thereby retaining the separate tool member within the tool. The step feature may comprise a ramp configured to allow the lock to slide out of the step feature when the separate tool member rotates between a predefined intermediate position relative the handle and a closed position.

In a further embodiment, the axle comprises a surface with at least one portion of the surface having a reduced diameter relative to the other surfaces. For example, the axle may comprise two flat surfaces located on opposite sides from each other on the surface of the axle.

In another embodiment, a tool is provided comprising a plurality of handles wherein at least one handle comprises a scale that defines an exterior surface of the handle. The tool also includes at least one tool member, such as a knife blade, carried by at least one of the handles and configured to transition between the open and closed positions along a path of travel. The tool further includes a lock carried by a respective handle, wherein the lock is configured to engage the tool member and hold the tool member in an open position relative to the respective handle. The tool also includes a tab defined by the scale and actuable from outside of the path of travel of the tool member. The tab is configured, upon actuation, to displace the lock and allow the tool member to fold back into the handle.

In an additional embodiment, the tool further comprises an axle upon which the tool member is mounted and about which the tool member rotates. In this embodiment, the tab may be positioned closer to the axle than to an opposite end of the handle. The tool may also comprise a pair of tabs on the scales on opposite sides of at least one handle. The tool may further comprise a dogleg associated with the lock with the dogleg being configured to permit the deflection of the tab to be translated into movement of the lock.

In one embodiment, a method of installing a tool member in a tool with a plurality of handles configured for relative movement between a closed position and an open position is provided. Such a method comprises providing a tool member comprising a tang that defines an open slot and that comprises a retention feature. The method also includes aligning the open slot of the tool member with an axle of a handle of the tool, sliding the axle of the handle into the open slot of the tool member, and engaging the retention feature of the tool member with a lock of the tool once the open slot of the tool member is mounted upon the axle.

In another embodiment, the method further includes providing a knife blade comprising a blade guard. In such an embodiment, the aligning step may comprise aligning the blade guard with the handle such that the blade guard guides the open slot of the tang onto the axle of the tool.

BRIEF DESCRIPTION OF THE SEVERAL VIEWS OF THE DRAWINGS

Figure 2:
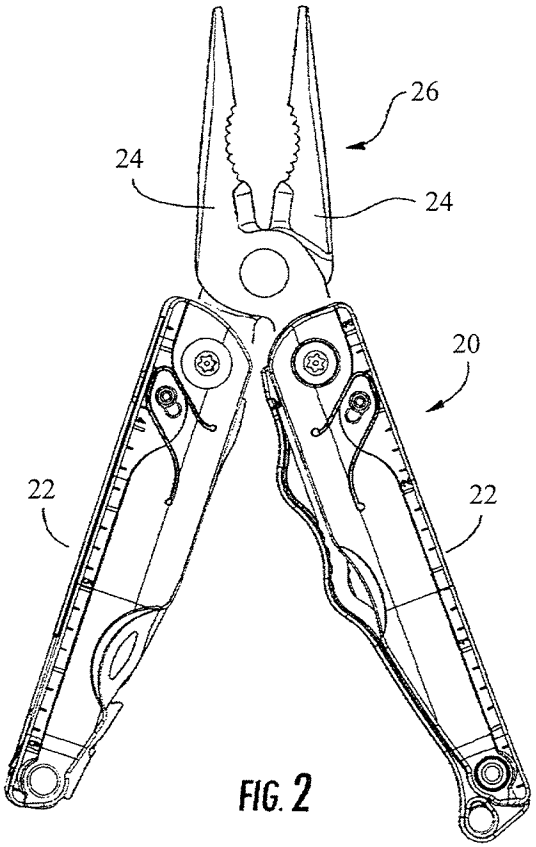
Figure 1:
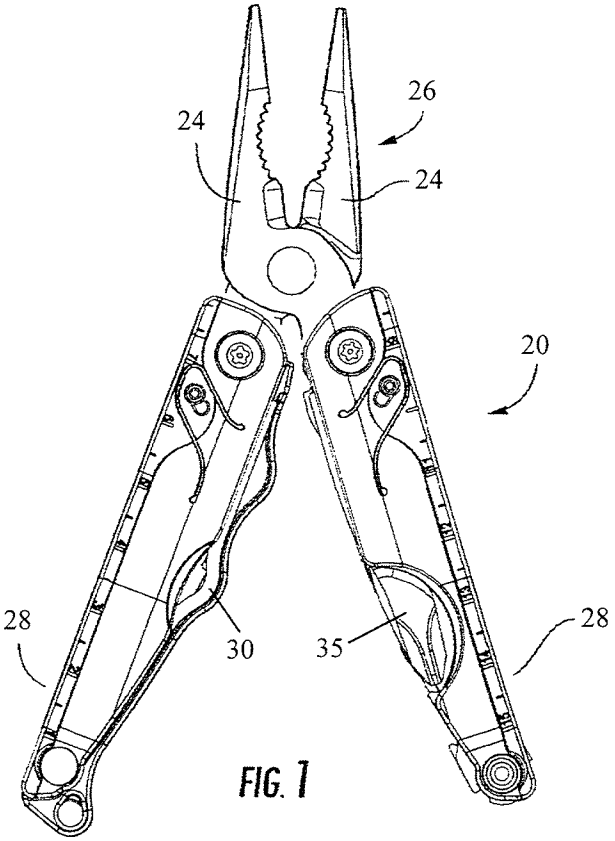
Figure 3:
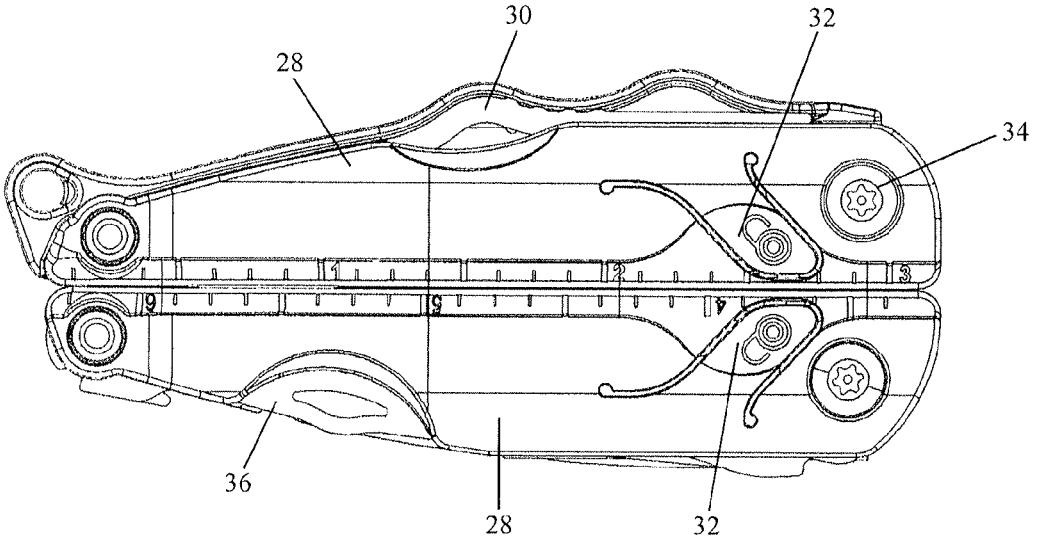
Figure 4:
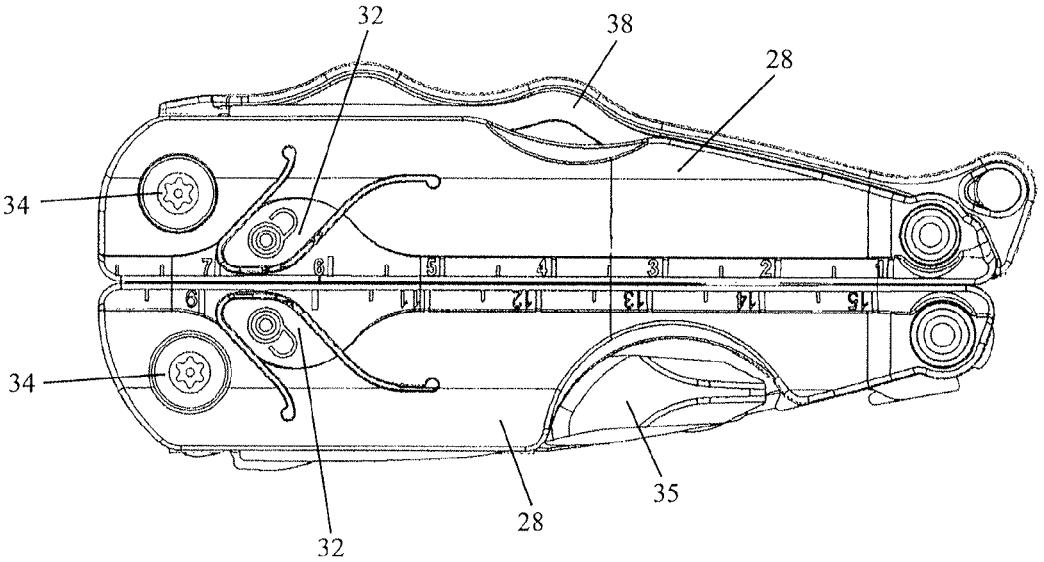
Figure 5:
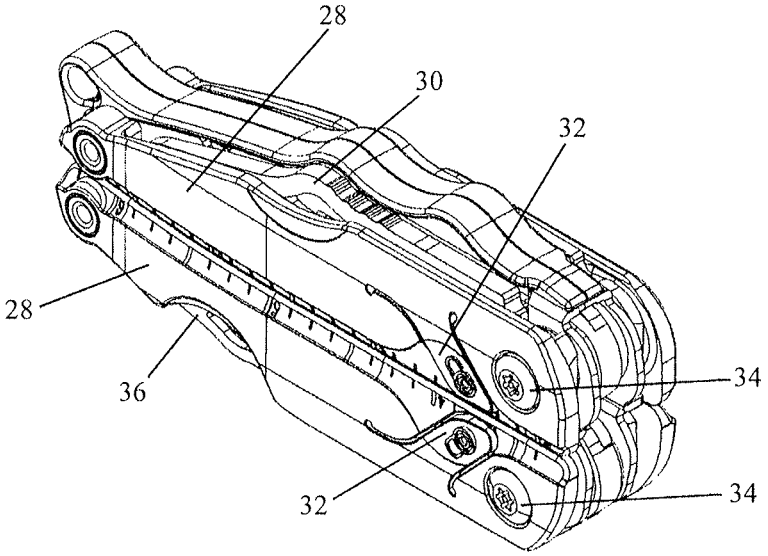
Figure 6:
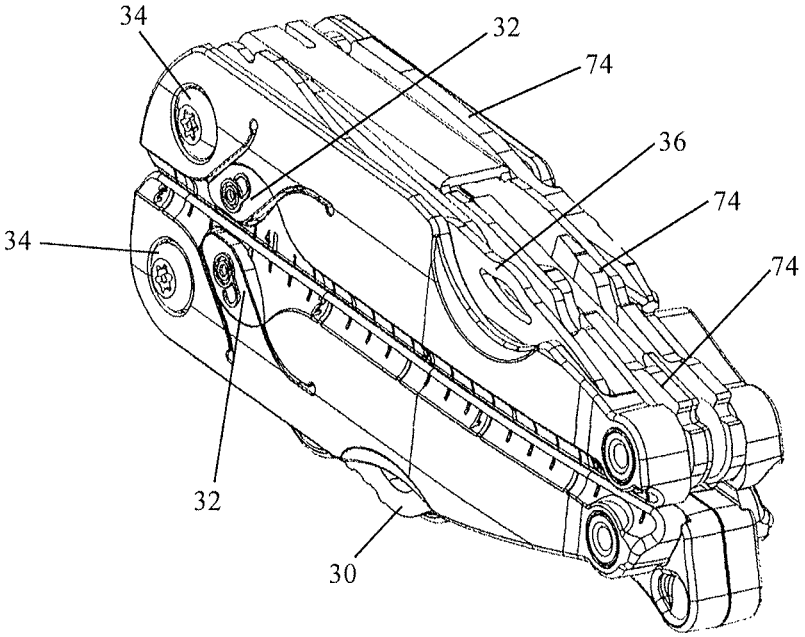
Figure 7A:
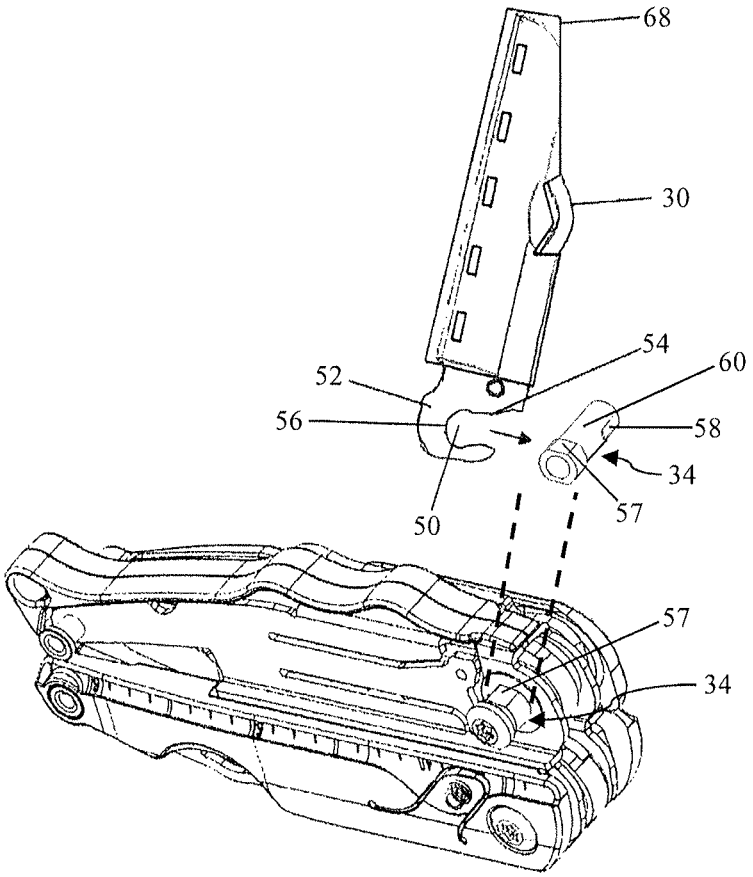
Figure 7B:
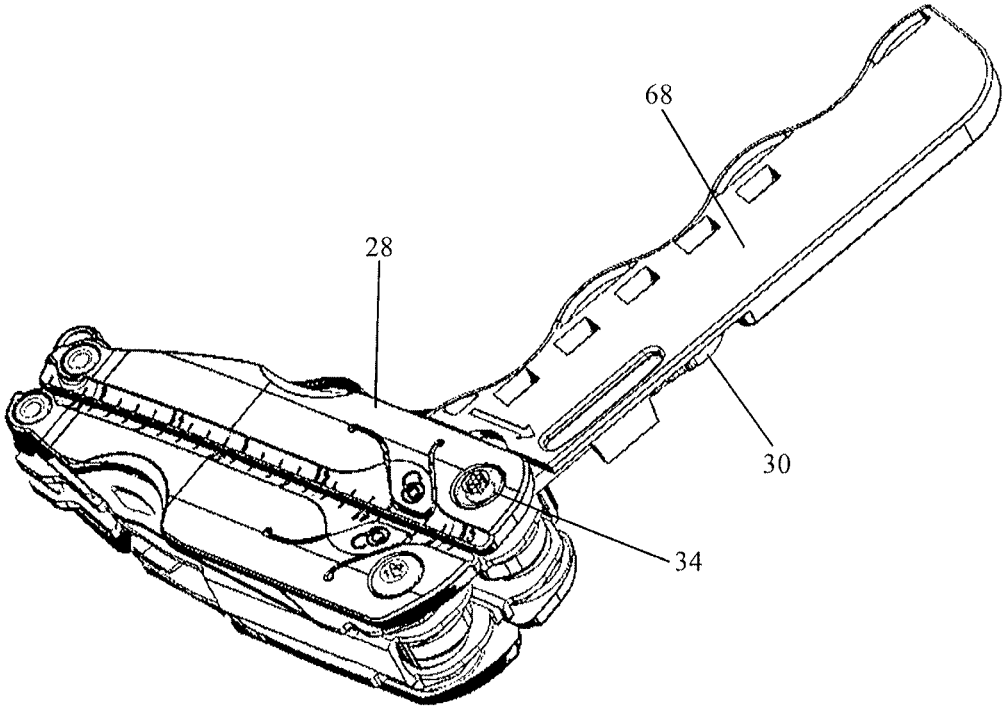
Figure 7C:
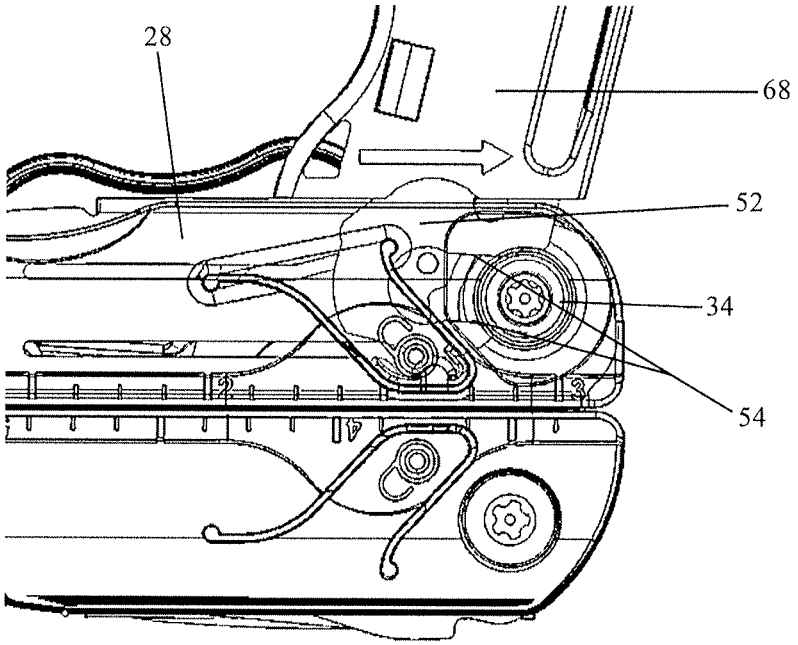
Figure 8:
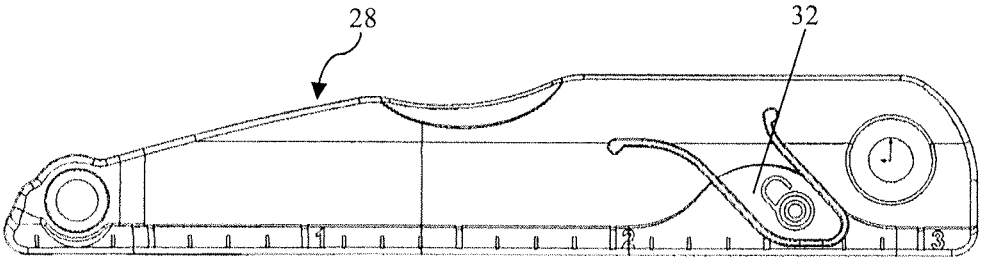
Figure 9:
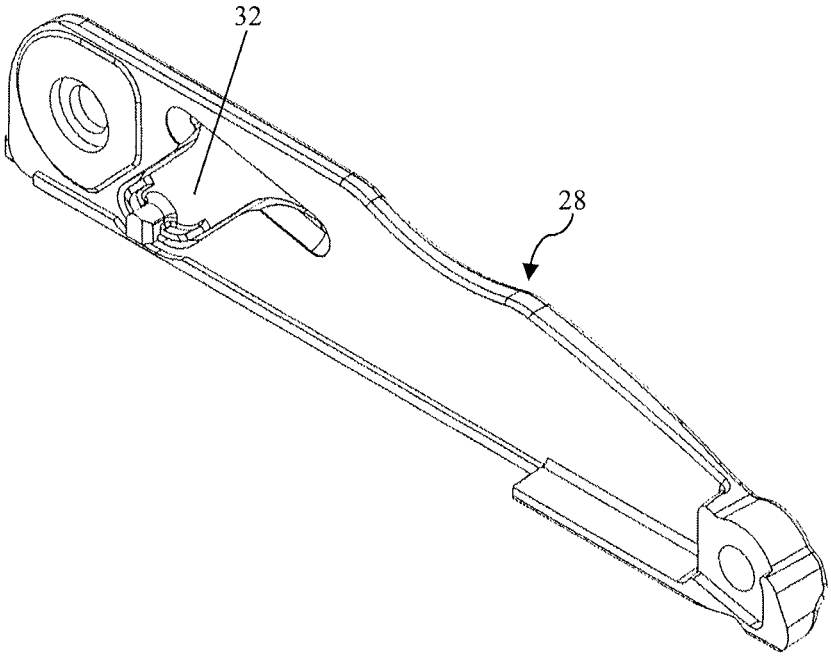

Having thus described embodiments of the invention in general terms, reference will now be made to the accompanying drawings, which are not necessarily drawn to scale, and wherein:

FIGS. 1 and 2 are views from opposite sides of a multipurpose tool according to an embodiment of the present invention in the open position;

FIGS. 3 and 4 are views from opposite sides of a multipurpose tool according to an embodiment of the present invention in the closed position;

FIGS. 5 and 6 are perspective views from opposite sides of the multipurpose tool of FIG. 3 in the closed position;

FIG. 7*a* is a perspective view of the multipurpose tool in the closed position with the scale removed from the top handle and illustrating the installation of a separate tool member onto the axle of the handle according to an embodiment of the present invention;

FIGS. 7*b* and 7*c* are a perspective view and a side view of the multipurpose tool illustrating the interaction between the blade guard and a scale of the tool so as to align the tool member with the axle of the tool in accordance with an example embodiment of the present invention;

FIGS. 8 and 9 are views of the outwardly and inwardly facing surfaces, respectively, of a scale of the multipurpose tool in accordance with one embodiment of the present invention.

Figure 10:
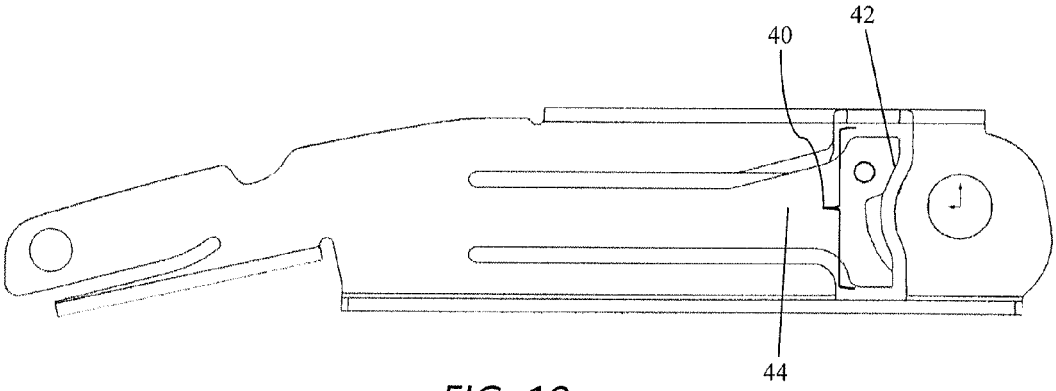
Figure 11:
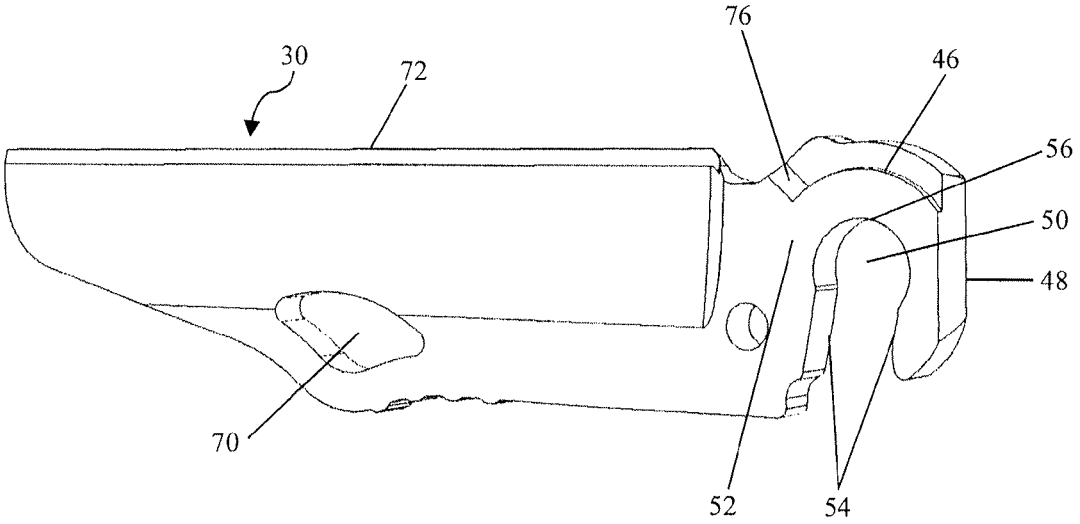
Figure 12:
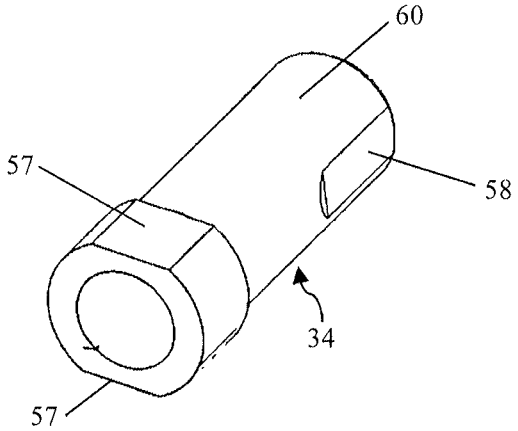
Figure 13:
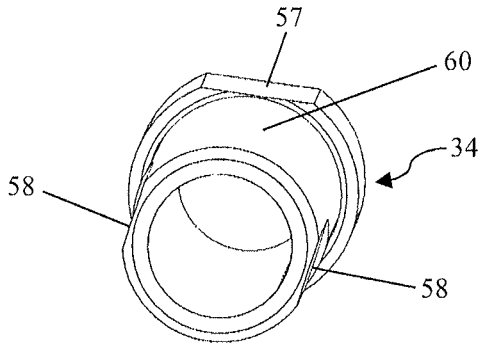
Figure 14:
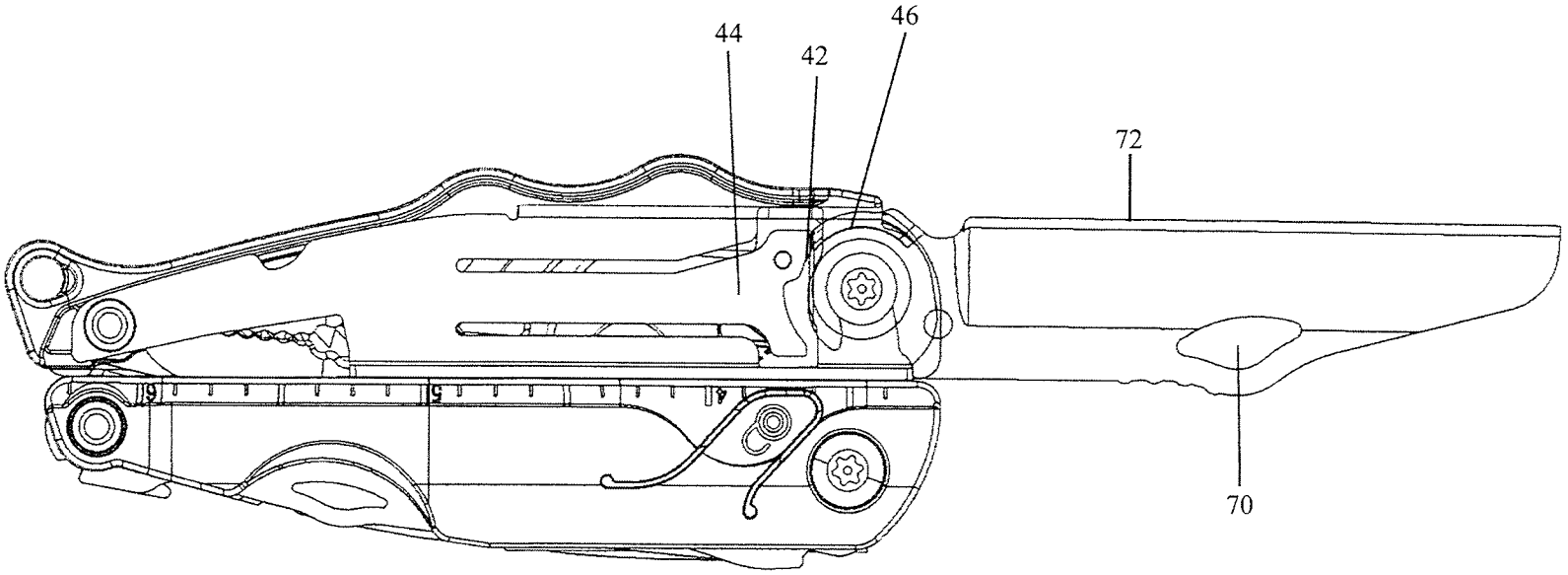
Figure 15:
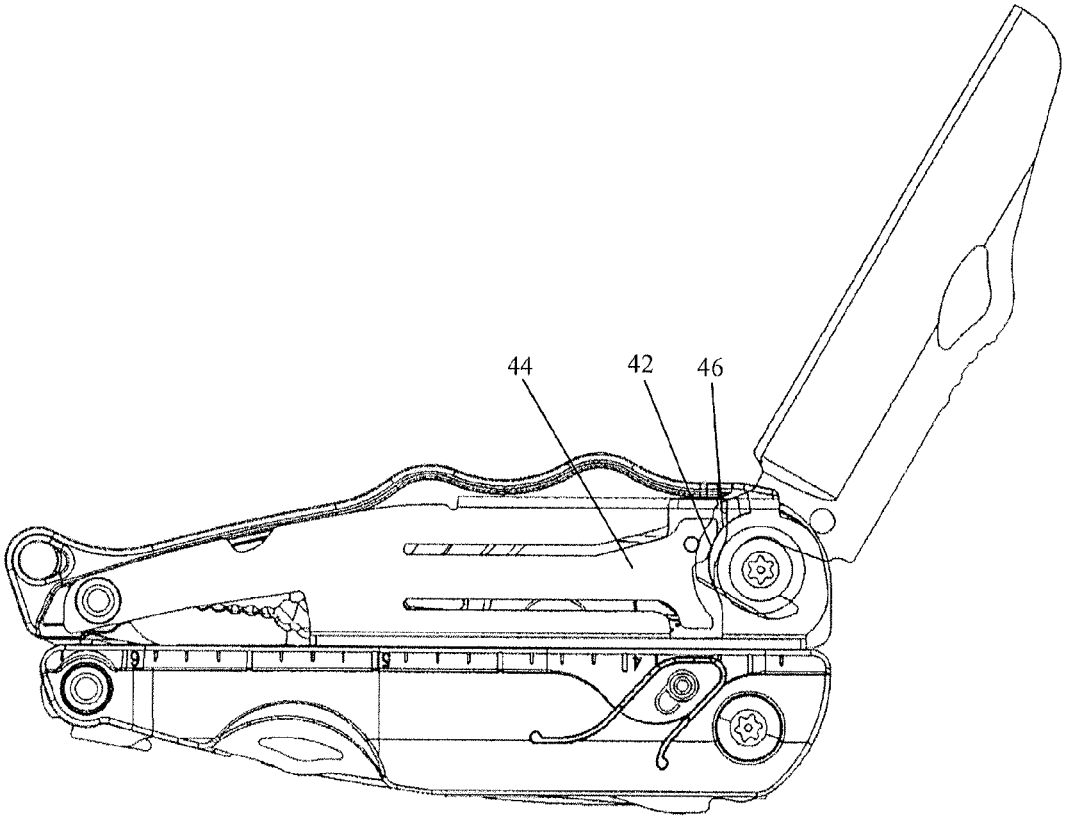
Figure 16:
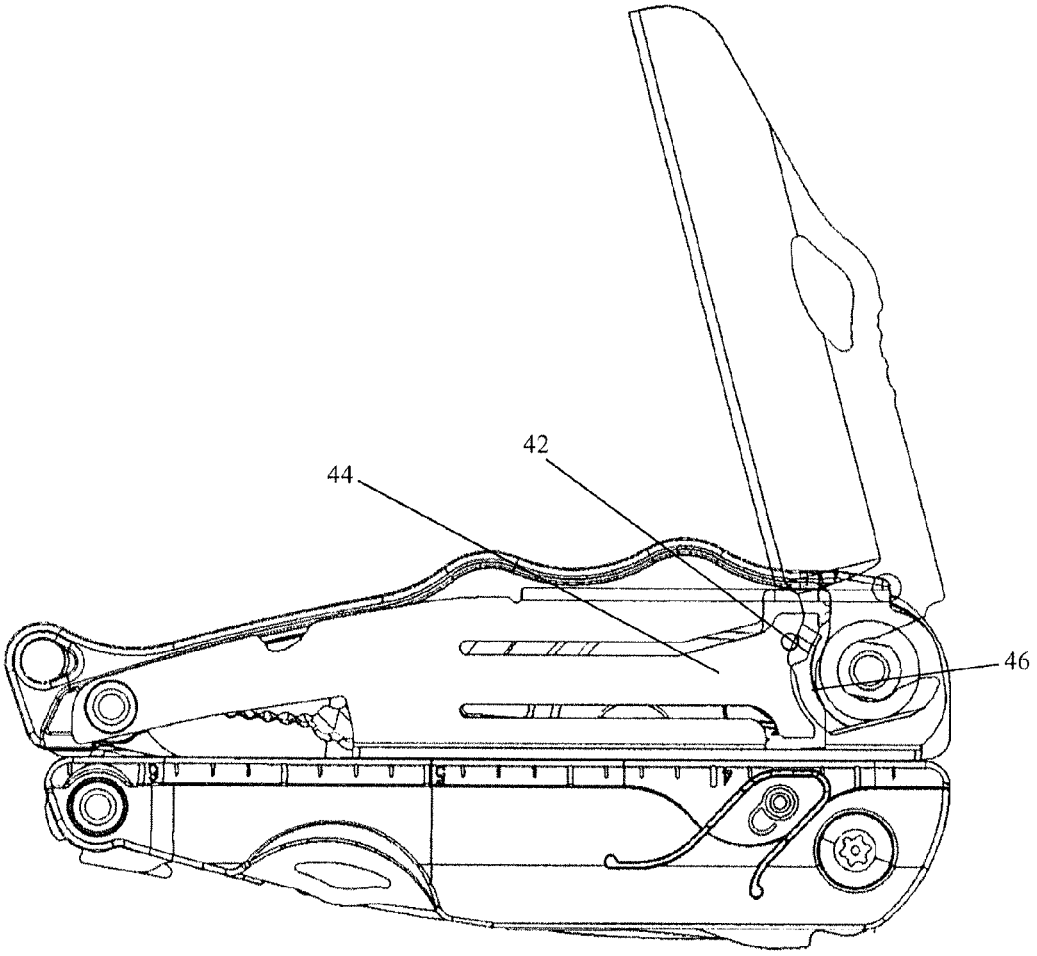

FIG. 10 illustrates a side view of the lock carried by a handle of a multipurpose tool in accordance with one embodiment of the present invention;

FIG. 11 illustrates a separate tool member, namely, a knife blade, that may be installed in the multipurpose tool in accordance with one embodiment of the present invention;

FIGS. 12 and 13 are a perspective view and an end view of the axle pin of the handle of the multipurpose tool in accordance with one embodiment of the present invention;

FIG. 14 is a side view of the multipurpose tool of FIG. 5 with the scale of the handle removed and showing the interaction of the knife blade and the lock when the knife blade is deployed in the open position according to an embodiment of the present invention;

FIG. 15 is a side view of the multipurpose tool of FIG. 5 with the scale of the handle removed and showing the engagement of the step feature of the knife blade with the lock when the knife blade is being folded from an open to a closed position in accordance with one embodiment of the present invention; and FIG. 16 is a side view of the multipurpose tool of FIG. 5 with the scale of the handle removed and showing the disengagement of the step feature of the knife blade with the lock when the knife blade is being folded from an open to a closed position in accordance with one embodiment of the present invention.

DETAILED DESCRIPTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Referring now to FIGS. 1-6, a tool, such as a multipurpose tool 20, according to one embodiment of the present invention is depicted. While the tool will be described in the context of a multipurpose tool, other types of tools may readily employ embodiments of the present invention including knives and other tools that are not considered multipurpose tools. For purposes of illustration, but not of limitation, a multipurpose tool employing an embodiment of the present invention will now be described.

The multipurpose tool 20 includes a plurality of handles 22 configured for movement relative to one another, as well a plurality of tool members carried by at least one of the handles. Typically, the multipurpose tool includes a pair of generally elongate handles that extend between opposed ends. As a result of their connection, such a pivotal connection, to one another and/or to one or more of the tool members, the handles can be moved toward and away from one another, such as in order to actuate a tool member as described below.

As also described below, the multipurpose tool 20 may be configured such that the handles 22 are adapted for relative movement between an open position as shown in FIGS. 1-2 and a closed position as shown in FIGS. 3-6 and discussed hereinafter. As will be apparent, the multipurpose tool has a compact form factor in the closed position so as to facilitate transport and storage of the multipurpose tool. While the multipurpose tool is more expansive in the open position, one or more of the tool members of the multipurpose tool are accessible and capable of being utilized in the open position, even though those same tool member(s) are stowed and generally inaccessible in the closed position.

Each handle 22 includes a pair of opposed sidewalls or scales 28 and a floor such that a cavity is defined within the handle to receive and store a plurality of tool members. With reference to FIGS. 1-2, a multipurpose tool 20 of one embodiment may include first and second handles 22 that are connected to the opposed jaws 24 of a tool member 26 having pivotable jaws, such as the pliers of the illustrated embodiment. In the open configuration, the handles may be moved toward one another in order to close the jaws of the pliers and away from one another in order to open the jaws of the pliers. In one embodiment, the jaws of the pliers are configured to contact one another once the jaws are in a fully opened position in order to prevent further opening of the jaws. Even though the jaws cannot be opened any further, the handles can be pivoted relative to the respective jaws in order to transition from the open position as shown in FIGS. 1-2 to the closed position as shown in FIGS. 3-6. Conversely, the handles 22 may transition from the closed position shown in FIGS. 3-6 to the open position shown in FIGS. 1-2 by pulling the handles away from one another and rotating the handles about the opposed jaws 24.

The multipurpose tool 20 can include a variety of tool members. For example, the multipurpose tool can include a tool member 26 having pivotable jaws 24, such as the pliers described above. Although not heretofore described, the tool member having pivotable jaws can also include wire cutters and/or wire strippers, or scissors, if desired. Additionally, the multipurpose tool of the embodiment depicted in FIGS. 1-6 includes a screwdriver 35, e.g., a Phillips screwdriver, scissors 36, a saw 38, and optionally a knife blade 30 carried by the handles 22. In this regard, the screwdriver, the scissors, the saw, and the knife blade may be rotatably connected to the respective handles. As shown in FIG. 14 with respect to the knife blade, the knife blade (as well as the saw and scissors) can be unfolded to a deployed position as shown in FIG. 14, particularly in instances in which the multipurpose tool is in the closed configuration.

In order to facilitate the rotation of a tool member, for example, the knife blade 30 from its stowed position, the knife blade can define an opening 70, typically opposite the cutting edge 72, that a user can grasp in order to rotate the knife blade outwardly away from the handle 22. In order to prevent access to the cutting edge of the knife blade while the knife blade is in a folded position, the scale or sidewall 28 that is attached or otherwise integral to the frame of the respective handle covers the cutting edge of the knife blade while the knife blade is in a folded position.

The multipurpose tool 20 can also include additional tool members 74, such as a screwdriver, bit driver, bottle opener, can opener, saw, razor, tweezers, gut hook or the like, that are folded into the channel defined by a handle 22.

An assembled tool may be provided to the user with a separate tool member that has not yet been assembled with the remainder of the tool, but that the user can install into the tool if desired. As such, a user may utilize the tool without the separate tool member if the user does not have any use for the separate tool member and, instead, desires a lighter and less complex tool. However, if the user desires to use the separate tool member, the user may install the separate tool member so as to add its functionality to that of the multipurpose tool. For purposes of the description, the separate tool member may include, but is not limited to, for example, a knife blade.

In order to facilitate the insertion of the separate tool member, the tool is provided with an opening or channel defined by the handle and configured to receive the separate tool member. Although the opening or cavity in the handle of the assembled tool can be left empty when the separate tool member is not installed, in some instances, it may be desirable to insert a temporary filler or cover (e.g., a plastic or metal piece) over or within the cavity that can be removed prior to installing the separate tool member.

In such a tool, the tool includes an axle 34 upon which the separate tool member (and in some embodiments other tool member(s)) is rotatably mounted in an instance in which a user wishes to install the separate tool member in the multipurpose tool. In order to facilitate installation, the separate tool member has a tang 52 with an open slot 50, as shown in FIG. 11. Although the open slot 50 may be configured in various manners, the open slot of the tang of the illustrated embodiment has a circularly shaped portion 56 concentric to the axis of rotation of the installed tool member with flat surfaces 54 on either side of the slot defining an opening along one edge of the separate tool member. Similarly, the axle may be configured in various manners, but, in the illustrated embodiment depicted in FIGS. 12 and 13, the axle has a concentric surface 60 with at least one portion of the surface having a reduced diameter relative to the other surfaces. For example, the axle may include a larger first end having a pair of opposed flat surfaces 57 and a cylindrical portion extending outward from the larger first end that also has a pair of flat surfaces 58 positioned on opposite sides from each other. The flat surfaces 58 on the cylindrical portion interface with the handle 22 and the flat surfaces 57 on the larger first end interface with the tool member, such as a knife blade, so as to define at least one relative position between the axle 34 and the open slot 50 of the separate tool member with enough clearance to allow the open slot of the separate tool member to slide onto the axle (with the open slot being unable to be slid onto the axle in all other orientations of the axle). By requiring the axle 34 and the open slot 50 to have a specific relative position in order to allow the open slot to slide upon the axle, the separate tool member is required to have a corresponding relative position, that is, a predefined installation position, to the handle of the tool (so as to create the specific relative position between the open slot and the axle) in order to install the separate tool member in the tool. In one embodiment, for example, the predefined installation position may require the separate tool member to be positioned substantially orthogonal to the handle.

When the slots of the tang are aligned with the flats of the axle and the tang of the tool member is slid onto the axle, the separate tool member is retained on the axle as a result of the separate tool member engaging a lock feature 44 of the tool, as described below. In the illustrated embodiment, the separate tool member also has a retention feature on at least one side which is engaged by a spring loaded lock, such as a liner lock, a frame lock, etc., to retain the tool member within the tool following installation of the separate tool member. The retention feature may be configured in various manners, but, in the illustrated embodiment, is a concentric step feature 46, such as a coined step feature, as shown in FIG. 11. The step feature 46 is located on the tang 52 of the tool member, such as about the periphery of the tang, is concentric to the axis of rotation of the installed tool member and extends around a portion of the tang, but not the entire circumference of the tang. The step feature 46 may include on at least one end a ramp 76 for engaging with the lock during rotation of the separate tool member.

Once the open slot 50 of the separate tool member has been slid onto the axle 34, the lock is disposed within, e.g., snaps into, the step feature 46 so as to retain the separate tool member. As shown in FIGS. 14-16, the tool member continues to engage with the spring loaded lock 44 during rotation from an open to a closed position. The lock 44, as shown in FIG. 10, includes a retention edge 42 designed to slide along the step feature as the separate tool member rotates about the axle 34 from an open to a closed position. FIG. 14 shows that when the installed separate tool member is in the open position, the step feature 46 of the separate tool member is not engaged with the retention edge of the lock 42. Instead, in the open position, the retention edge of the lock 42 is positioned so as to engage an end surface 48 of the tool member to retain the tool member in the open position. In this embodiment, the lock must be displaced relative to the tool member in order to close the tool member. For example, the tool may include an actuation member, such as a tab 32 as described below, to permit a user to apply the force necessary to displace the lock and permit rotational closing of the tool member.

As the separate tool member rotates from an open to a closed position, the retention edge of the lock 42 slides along the step feature 46 of the separate tool member, as shown in FIG. 15. In this embodiment, when the separate tool member rotates between a predefined intermediate position, such as a position in which the tool member extends orthogonally outward from the handle, and a closed position, as shown in FIG. 16, the lock slides along the ramp 76 of the step feature that smoothly transitions from step feature (having a reduced thickness) to the main body of the tang (having a greater thickness), thereby disengaging the lock from the edge of the tool member. In other words, the ramp transitions along the step and tapers off at the end of the step which allows the lock to fall off the step feature.

As discussed above, the user will have the option to install a separate tool member onto the tool following purchase and/or delivery of the tool. Thus, the user can tailor the tool as desired. As such, a method of installing a tool member onto an already assembled tool is provided. If a filler or cover has been inserted into the opening on the handle, it should be removed prior to installation of the separate tool member. In such a method, the tool member is aligned such that the open slot 50 on the tang 52 of the tool member slides onto the axle 34 of the handle, as illustrated in FIG. 7*a*. In order to engage the retention mechanism described above, the separate tool member is pushed through the load of the spring loaded lock 44 until the retention feature of the tool member engages with the lock of the tool and snaps into place on the axle of the tool.

In some cases, a guard may be carried by the separate tool member during installation. In the example of a knife blade, a blade guard 68 may be used, such as one shown in FIG. 7*a*, in order to cover a sharp cutting surface to prevent inadvertent contact therewith during the installation process. In one embodiment, the blade guard 68 may include or carry installation instructions, such as engraved or molded into the blade guard or attached to the blade guard. The blade guard 68 not only allows for user safety during installation, but also guides the open slot 50 on the tang 52 of the knife blade 30 onto the axle 34 of the tool. In this regard, with the blade guard 68 installed on the knife blade 30, the knife guard guides the tang 52 of the knife blade by controlling the depth and angle of the slot 50 defined by the tang to the depth and angle of the axle 34. In this regard, the blade guard 68 of an example embodiment may have an edge thickness that corresponds to the corresponding edge of the scale. When these edges of the blade guard 68 and the scale are held flush, the tang 52 of the knife blade 30 and the axle 34 are properly oriented to permit the knife blade to be slid into place, as shown in FIGS. 7*b* and 7*c*. In this regard, it is noted that FIG. 7*c* treats the handle and scale as translucent such that internal components of the tool including the tang 52 of the knife blade 30 and the axle 34 may be visible for purposes of illustration. As such, the blade guard 68 allows for at least one, but not every, relative position of the separate tool member to the handle, that is, a predefined installation position such as in an instance in which the separate tool member extends orthogonally relative to the handle, to have enough clearance with respect to the handle to allow the separate tool member to slide onto the axle so it can then be captured by the lock and folded into the opening in the handle. Thus, the blade guard may facilitate installation of the separate tool member in an intuitive manner. The blade guard 68 may be formed of various materials, but, in one embodiment, is formed of a plastic material. The blade guard may be removed from the separate tool material prior to or following installation of the separate tool member to the tool. In this regard, the blade guard may be slid off of or otherwise removed from the tool member. In another embodiment, the blade guard may be configured such that rotation of the separate tool member from the predefined installation position to the closed position may cause the blade guard to be disengaged from the separate tool member.

When the tool member of a tool is in the open position, the tool member may be locked open, as depicted in FIG. 14. In order to fold the tool member back into the tool, the lock mechanism, such as a liner lock, frame lock, etc., may be displaced by the user while rotating the tool member into the closed position. The lock 44 may be displaced so as to permit folding of the tool member by pressing an actuation mechanism, such as a tab 32 or tabs, on the tool. The tool member of the illustrated embodiment has a lock release mechanism that allows the user to fold a tool member into the tool without placing fingers in the path of travel of the tool member. In this regard, at least one of the handles 22 of the tool including at least the handle that includes the lock mechanism 44 has a scale 28 that defines the exterior surface of the handle. In some instances, the scale may be plastic. As shown in FIGS. 8 and 9, the actuation mechanism, such as a tab 32, may be cut into or otherwise formed by the scale 28. The tab 32 is in operable engagement with the lock 44 and is configured for actuation, e.g., deflection, by the user to permit the lock to be displaced and the tool member permitted to be folded into the handle. In this regard, the user can push in the tab 32 with a finger in order to release the lock. In one embodiment, the lock includes or is otherwise associated with a dogleg 40, as depicted in FIG. 10. In this embodiment, the tab 32 is also in operable engagement with the dogleg 40, such that deflection of the tab causes a corresponding movement of the dogleg and, in turn, deflection of the lock, thereby allowing the tab to push the lock out of the path of the tool member and permitting the tool member to be folded from the open to the closed position.

As shown in FIGS. 3 and 5, the tab(s) 32 may be positioned on the tool such that the tab(s) is closer to the axle 34 upon which the tool member rotates than to an opposite end of the handle. The tabs may include a pair of tabs on the scales 28 on opposite sides of at least one of the handles. The tabs may also include one or a pair of tabs on both handles. Each tab is configured to deflect a lock carried by the respective handle so as to unlock a tool member and to permit the tool member to be folded into the respective handle.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A tool comprising:

a plurality of handles configured for relative movement between a closed position and an open position, wherein at least one of the plurality of handles includes an axle;

a plurality of tool members carried by at least one of the plurality of handles;

a separate tool member configured to be installed following assembly of the tool, wherein the separate tool member comprises a tang and defines an open slot on the tang, wherein the open slot is configured to receive the axle; and a lock carried by a respective handle, wherein the lock is configured to engage the separate tool member upon installation of the separate tool member such that the open slot of the separate tool member is rotatably mounted upon the axle;

wherein the tang of the tool member includes a retention feature and the lock is configured to engage the retention feature to secure the separate tool member within the tool following the installation of the separate tool member, wherein the tang has opposed first and second side surfaces with the open slot defined to extend therebetween, and wherein the retention feature of the tang includes a step feature along an edge of the tang that is recessed relative to the first side surface of the tang and that is configured to be engaged by the lock.

2. The tool of claim 1, wherein the step feature extends around a portion of the tang concentric to the slot on the tang.

3. The tool of claim 1, wherein the lock comprises a retention edge designed to engage the step feature of the separate tool member.

4. The tool of claim 3, wherein the retention edge slides along the step feature as the separate tool member rotates along the axle from an open to a closed position.

5. The tool of claim 3, wherein the step feature is not engaged with the retention edge of the lock when the separate tool member is in the open position.

6. The tool of claim 1, wherein the axle comprises a surface with at least one portion of the surface having a reduced diameter relative to the other surfaces.

7. The tool of claim 6, wherein the axle comprises two flat surfaces located on opposite sides from each other on the surface of the axle.

8. The tool of claim 1, wherein the separate tool member comprises a knife blade.

9. The tool of claim 8, further comprising a blade guard configured to be removably mounted upon the knife blade.

10. A tool comprising:

a plurality of handles configured for relative movement between a closed position and an open position, wherein at least one of the plurality of handles includes an axle;

a plurality of tool members carried by at least one of the plurality of handles;

a separate tool member configured to be installed following assembly of the tool, wherein the separate tool member comprises a tang and defines an open slot on the tang, wherein the open slot is configured to receive the axle such that the separate tool member is rotatably mounted upon the axle; and a lock carried by a respective handle, wherein the lock is configured to engage the separate tool member upon installation of the separate tool member such that the open slot of the separate tool member is mounted upon the axle, wherein the tang of the tool member includes a step feature and the lock is configured to engage the step feature to secure the separate tool member within the tool following the installation of the separate tool member, wherein the step feature comprises a ramp configured to allow the lock to slide out of the step feature when the separate tool member rotates between a predefined intermediate position relative to the handle and a closed position.

11. A method of installing a tool member on a tool with a plurality of handles configured for relative movement between a closed position and an open position, the method comprising:

providing a tool member comprising a tang that defines an open slot, wherein the tang comprises a retention feature, wherein the tang has opposed first and second side surfaces with the open slot defined to extend therebetween, and wherein the retention feature of the tang includes a step feature along an edge of the tang that is recessed relative to the first side surface of the tang;

aligning the open slot of the tool member with an axle of a handle of the tool;

sliding the axle of the handle into the open slot of the tool member; and engaging the step feature of the tool member with a lock of the tool once the open slot of the tool member is mounted upon the axle.

12. The method of claim 11, wherein providing the tool member comprises providing a knife blade comprising a blade guard.

13. The method of claim 12, wherein the aligning comprises aligning the blade guard with the handle such that the blade guard guides the open slot of the tang onto the axle of the tool.

* * * * *